US006397976B1

(12) United States Patent
Hale et al.

(10) Patent No.: US 6,397,976 B1
(45) Date of Patent: Jun. 4, 2002

(54) AUTOMATIC ELEVATOR DESTINATION CALL PROCESSING

(75) Inventors: Charles F. Hale, Farmington; Daniel R. Drop, Durham, both of CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/411,571

(22) Filed: Oct. 4, 1999

(51) Int. Cl.[7] ..... B66B 1/34

(52) U.S. Cl. ..... 187/392; 187/384; 187/389

(58) Field of Search ..... 187/380, 381, 187/382, 389, 384, 388, 390, 391, 393; 49/24, 31; 340/825.06, 825.19, 825.27, 825.28, 825.31, 825.34; 307/10.1

(56) References Cited

U.S. PATENT DOCUMENTS

| | | | | | |
|---|---|---|---|---|---|
| 4,590,604 | A | * | 5/1986 | Feilchenfeld | 381/42 |
| 5,541,585 | A | * | 7/1996 | Duhamme et al. | 49/31 |
| 5,554,832 | A | * | 9/1996 | Lumme et al. | 187/380 |
| 5,689,094 | A | | 11/1997 | Friedli et al. | 187/384 |
| 5,749,443 | A | * | 5/1998 | Romao | 187/384 |
| 5,831,533 | A | * | 11/1998 | Kanno | 340/573 |
| 5,952,626 | A | | 9/1999 | Zaharia | 187/381 |
| 5,973,611 | A | * | 10/1999 | Kulha et al. | 307/10.1 |
| 5,984,051 | A | * | 11/1999 | Morgan et al. | 187/392 |
| 6,002,332 | A | * | 12/1999 | King | 340/545.1 |
| 6,011,839 | A | * | 1/2000 | Friedli et al. | 187/388 |
| 6,088,450 | A | * | 7/2000 | Davis et al. | 380/25 |
| 6,109,396 | A | * | 8/2000 | Sirag et al. | 187/381 |
| 6,202,799 | B1 | * | 3/2001 | Drop | 187/388 |

FOREIGN PATENT DOCUMENTS

| | | | |
|---|---|---|---|
| DE | 196 08 382 A1 | 11/1997 | B66B/1/14 |
| EP | 0 879 782 A1 | 12/1998 | B66B/1/46 |
| FR | 2 785 597 | 8/1999 | B66B/1/20 |

* cited by examiner

*Primary Examiner*—Jonathan Salata

(57) ABSTRACT

A potential elevator passenger or occupant (bearer) carries a portable transmitting device with which he must overtly indicate his intent to take an elevator trip before interrogation by a beacon will cause an elevator call to be automatically registered for him, or indicate his intent before gaining access to a space. The intent to take a trip is cancelled when the bearer enters an elevator car, requiring an additional overt act prior to entering an automatic elevator call the next time that the bearer approaches an elevator. Default destinations (floors or spaces) may be signified for the bearer, depending on the floor where the device is located, or the bearer may establish an alternative destination, the alternative destination being cancelled from the device when the bearer enters an elevator or gains access to a space. The intent may be managed and a default destination may be provided either by the portable device or by a system in the building. Authentication of the bearer's voice may precede provision of the token. Tokens may be manifested by the presence alternative destinations.

26 Claims, 8 Drawing Sheets

AUTOMATIC ELEVATOR DESTINATION CALL PROCESSING

TECHNICAL FIELD

This invention relates to registering the desire of a passenger to have an automatic elevator call entered for him, selection of a default destination or of a passenger input destination for the automated call, and limiting the use thereof to a single trip.

BACKGROUND ART

The automatic entry of destination calls in order to better allocate elevators to respond to the calls and to avoid passengers using a keyboard at the elevators in order to enter their calls, has been shown to have two major problems. The first problem is that many times persons walking through an elevator corridor have no intention of utilizing the elevator, but a call will be automatically placed for such person; the number of false calls causes the potential advantage in dispatching to be totally lost, and wastes elevator capacity as well. The second problem is that passengers at the elevator must enter calls with push buttons or keys, or must utilize push buttons or keys to change calls when the destination of the automated call is not the desired destination of the passenger for this particular trip. This causes a clutter of passengers attempting to make call entries near the elevators.

A significant improvement is described in commonly owned U.S. patent application Ser. No. 09/111,355 filed Jul. 7, 1998. Therein, voice badges are carried by passengers and they must indicate by voice whether or not they wish to travel on the elevator. In addition, a passenger can indicate a destination floor other than the normal, default destination floor, as his desire for the ensuing trip. In that system, a far beacon, remote of the elevator, wakes up the badge and causes it to alert the passenger to indicate his intentions. If the passenger says "elevator" or the like, and does not indicate a different floor, such as "office" or "37", the call will be entered for the normal, default floor. If the passenger verbalizes a different floor, the call is placed with that floor as the destination. The call may be assigned to a car, and the number of the assigned car may be communicated to the badge for announcement to the passenger. When the passenger reaches the elevator, another beacon will alert the badge to respond, to see if the passenger for whom the call was made has indeed reached the elevator. If not, the stop may be cancelled if there is no other passenger requesting a stop at that floor. This system avoids the problem of entering false calls when a person is passing through the lobby with no intent to use the elevator; the verbal operation offers the opportunity to communicate with the elevator without use of the passenger's hands. However, voice recognition and voice synthesis consume a significant amount of power. Generally speaking, talking to a badge in a place where other users are also talking to their badges can create significant audible background noise and thereby cause lack of recognition or misrecognition of the passenger's intent. Furthermore, some people are reluctant to talk to badges in public. In addition, if the badges are not clipped close to the neck, they may have to be held in the hand to make them adequately responsive for accurate call placement.

U.S. Pat. No. 4,979,594, discloses a frequently used, default destination for automatically entered elevator calls. In the patent, the device may be in an automatic mode, or in a manual, push button mode. Use of the push buttons must be near the elevator, therefore negating hands-free operation near the elevator. Furthermore, if the operator fails to switch from the push button mode to the automatic mode, excessive use of battery power may result and undesired calls may be entered. A related problem is determining when a passerby desires to enter a space having automatic door control, particularly where security is involved.

DISCLOSURE OF INVENTION

Objects of the invention include reduction of false calls in an automatic elevator call system; significant reduction in battery power required in an automatic elevator call system; reduction of mixed signals approaching or at the elevator as a consequence of numerous passengers speaking to their devices; an automatic elevator call system allowing hands-free operation near the elevator; an improved methodology for managing overt intent indications from a potential passenger in an automated elevator call system; improved automatic access to space; and improved management of authenticated access to secure spaces, elevators, and elevator destinations.

According to the present invention, an automated access system utilizes unique portable devices carried by each individual bearer for transmitting the bearer's intent to gain access to spaces or utilize elevators; the transmitted intent is defined herein as a "token", which is automatically cancelled when the bearer enters a space or receives elevator service. Elevator call system embodiments also transmit the desired destination for the passenger's next elevator trip. The destination and/or token may be preset remotely of the spaces or the elevators, respectively, when the portable device is outside of the range of any beacons. The elevator destination may either be a normal, default destination established for that passenger for elevator trips leaving from the floor of a beacon which activates the portable device, or the destination may be a destination established by an input into the portable device provided by the bearer. The disclosed exemplary embodiments utilize voice or keys, buttons, and displays, or combinations of them, for communication between the individual bearer and the portable device.

The token may be provided in security situations only if voice authentication is successful.

The invention eliminates false calls by requiring that a potential passenger overtly indicate an intent to utilize the elevator. The invention avoids call or access interference and the use of hands in the vicinity of the elevators or spaces by allowing all inputs to the portable device to be made remotely, whether keys or voice are used. The invention avoids incorrect or false elevator calls or access to space by cancelling the token and the established destination as soon as the bearer boards an elevator car or enters a space, and excessive battery use is avoided by virtue of the process of the invention.

Other objects, features and advantages of the present invention will become more apparent in the light of the following detailed description of exemplary embodiments thereof, as illustrated in the accompanying drawing.

BEST MODE FOR CARRYING OUT THE INVENTION

The invention may be used to control access to a space, or for automatic elevator calls. As an example only, an elevator system is described, and modifications thereto for use in space-access system are described.

Figure 1:
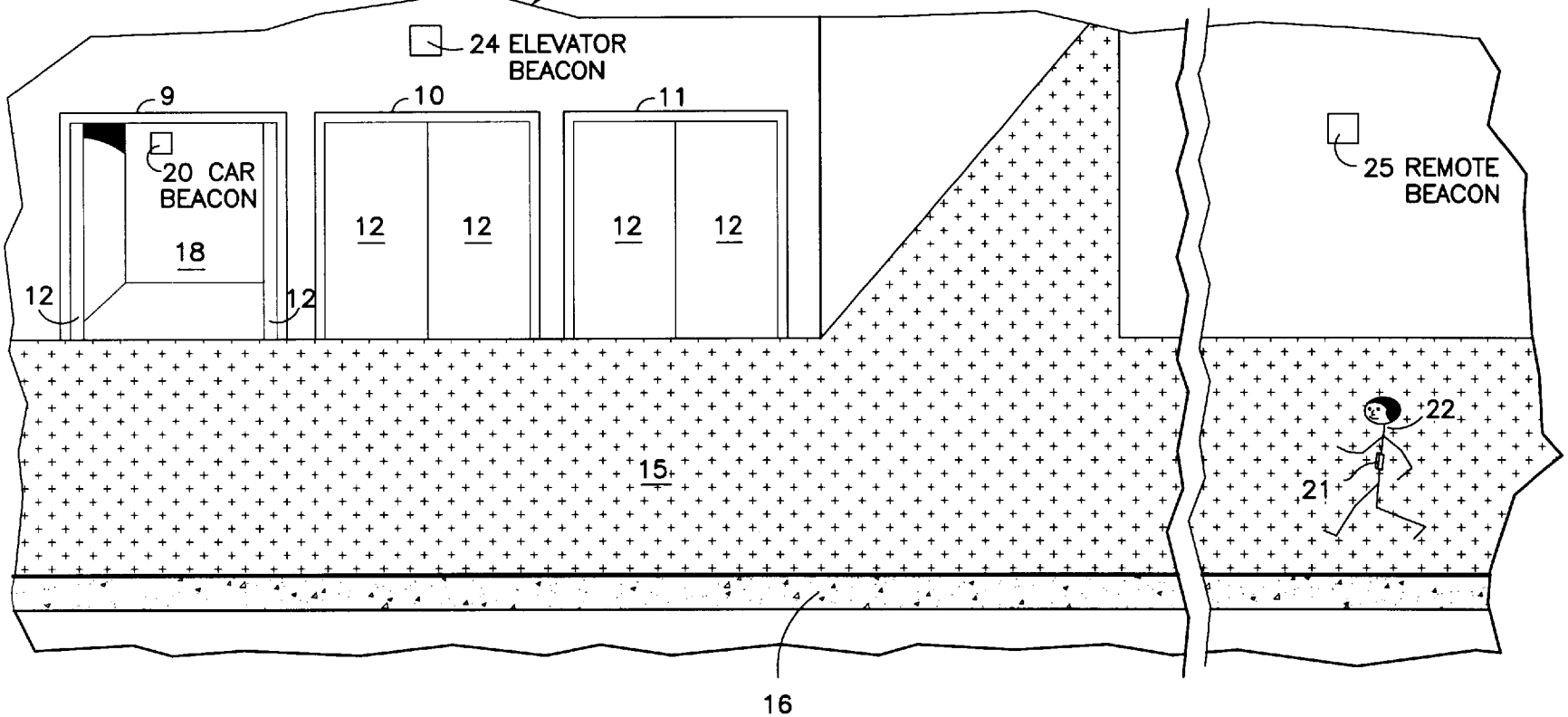
FIG. 1 is a stylized, perspective view of an elevator corridor illustrating beacons which may be used with the present invention.

Referring to FIG. 1, a plurality of elevators have doors 12 that open, as shown for the elevator 9, onto an elevator corridor 15 on a floor 16 of a building 17. A car 18 of each elevator includes a beacon 20 which may be a transponder, which wakes up a portable device 21 worn or carried by a bearer, such as a passenger 22, and also receives a transmitted ID number, destination floor number, and the like from the device 21. The building may also have additional beacons, such as an elevator beacon 24 and a remote beacon 25, at least one which may be transponders to receive at least a destination floor number or an ID number from the device 21, in order to place a call for the passenger 22.

The device 21 may typically comprise a microprocessor having a data input capability, such as voice (FIG. 2) recognition or keys (FIG. 3), so that the passenger may enter his intent to utilize the elevators, and so that the passenger may input the identification of a floor which he wishes to use as his destination.

Figure 2:
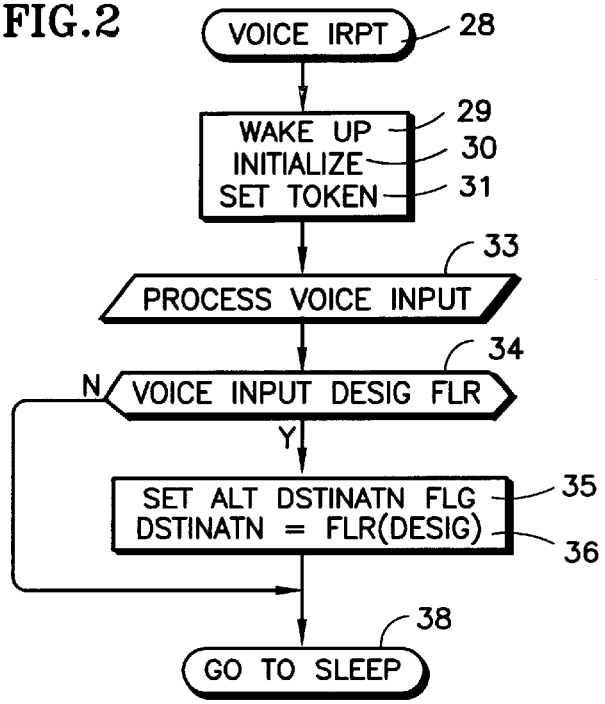
FIG. 2 is a simplified macrofunctional diagram of a voice interrupt of a portable device in accordance with the present invention.

In a first embodiment of the invention illustrated in FIG. 2, it is assumed that the portable device 21 is a voice responsive badge, which may be of the type disclosed in the aforementioned application. The device may include a conventional microprocessor which has a sleep mode in which its only function is to wake up, and which therefore consumes a very small amount of energy most of the time. In such a case, the microprocessor may be set to respond to the human voice to wake up and perform certain functions, as illustrated in FIG. 2. Therein, a voice interrupt will reach a routine through an entry point 28 and a first pair of steps 29, 30 will cause the microprocessor to wake up and initialize. Then, a step 31 will set a token indicating that the passenger does intend to take a trip in an elevator the next time he approaches an elevator. In this embodiment, it is assumed that if the passenger says anything at all, it will indicate he intends to ride in an elevator the next time he approaches one, and therefore the token is set automatically. However, the passenger may also enunciate the identification of a particular floor, such as by stating a number or by stating a function (office, lobby) indicative of a floor. A conventional voice processing subroutine 33 will process any verbal inputs to the device, to determine the meaning of any words said after the device has woken up. In the simplest of embodiments, all that may be achieved by the subroutine 33 is to automatically set a token and determine if a floor has been identified. If it has, then an affirmative result of a test 34 will reach a pair of steps 35, 36 to set an alternative destination flag and to set a destination value equal to the number of the floor which was identified by the subroutine 33. Having done that, the routine of the voice interrupt is concluded by causing the microprocessor to resume sleep through a point 38. On the other hand, if the passenger had only spoken some word to indicate intent to use the elevator, a negative result of test 34 will bypass the steps 35, 36 and cause the microprocessor to resume sleep at the point 38.

The invention may be embodied with a portable device 21 which utilizes keys, either as an alternative to voice, or in addition to voice. In such a case, a key interrupt routine illustrated in FIG. 3 may be reached through an entry point 40 in response to depression of any key on a device, and a first pair of steps 41, 42 will cause the microprocessor to wake up and initialize. In this embodiment, it is assumed that the device can be awakened by pressing any key, but if indeed it is awakened by pressing a key indicating an intent to take an elevator trip, then an affirmative result of a test 44 will reach a step 45 to set the token (the same token which may be set automatically in the embodiment of FIG. 2). But if the intent key was not depressed, a negative result of test 44 will bypass the step 45. Then a subroutine 47 will process any of the keys that might designate destination. These may be function keys having names such as lobby, office, cafeteria; they may be a plurality of keys that each identifies a given floor number; or they may comprise a keypad upon which a sequence of one or more keys is pressed to identify a floor number. In any event, if the subroutine 47 determines that destination keys have designated a given floor, then an affirmative result of a test 48 will reach a step 51 to set the alternative destination flag and a step 52 to set the destination for the next trip of that passenger to be equal to the number of the floor that is designated in the subroutine 47. And then the microprocessor will once again resume sleep through a point 54. However, if a destination floor has not been designated, a negative result of test 48 bypasses the steps 51, 52, causing the microprocessor to resume sleep through the point 54. If desired, the routine of FIG. 3 can be utilized without either establishing intent or identifying an alternative destination. The routine, for instance, may have a display subroutine so that simply waking the device up will cause a subroutine to display the current next destination, whether it has previously been established by the step 52 or in a fashion described hereinafter. However, these alternatives are irrelevant to the present invention.

Figure 3:
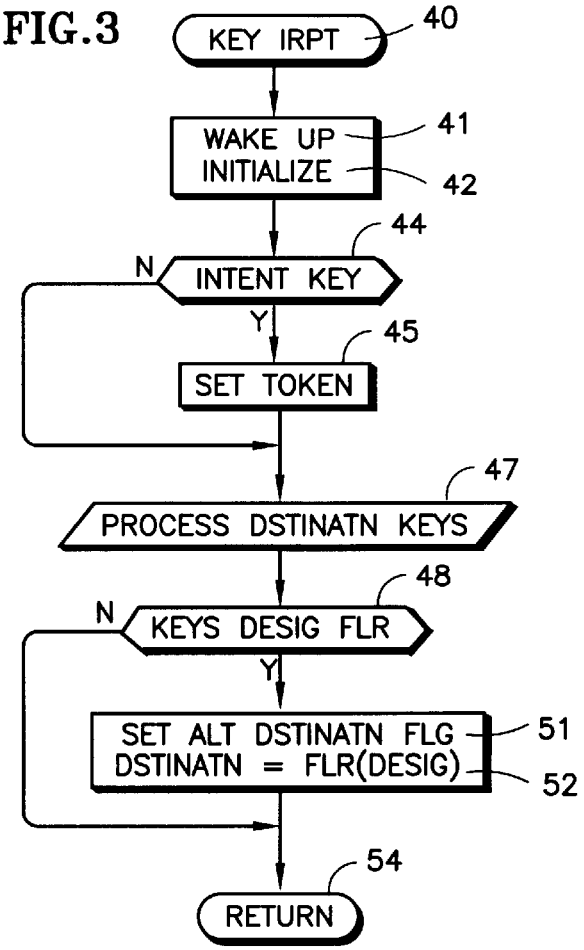
FIG. 3 is a simplified functional diagram of a key interrupt which might be used in a device of an alternative embodiment of the present invention.

In accordance with the invention, depending upon the embodiment, the functions of FIG. 2 or the functions of FIG. 3 may be performed while the passenger is a significant distance from the elevators. Later on, which may be very remote in time, or only a few moments, as the passenger approaches the elevators, a beacon, such as one of the beacons 24, 25 (FIG. 1), will wake up the microprocessor. In such a case, the beacon interrupt routine of FIG. 4 may be reached through an entry point 57, and a first pair of steps 58, 59 will cause the microprocessor to wake up and initialize. Then a step 62 may store the name of the beacon, identifying its location in the building, such as "west corridor", "elevator corridor", or "car 3. In a space-access system, the beacon will transmit the number of a door ("door" may include gate)" with which it is associated. A step 63 will store the number of the floor, the car, or the door on or near which the beacon is situated. The beacons will transmit names and floor or door numbers as necessary, after transmitting a sufficient number of bits to wake up the microprocessor and cause it to become initialized, in time for the microprocessor to be able to recognize the name and/or number messages. A test 65 determines if the token was set, either automatically as set in step 31 of FIG. 2, or by means of a key as set in step 45 of FIG. 3. If the token has not been set, a negative result of test 65 causes the remainder of the routine to be bypassed and the microprocessor will go to sleep through a point 66. If the token had been set, then an affirmative result of test 65 reaches a test 68 to see if the alternative destination flag had been set in either step 35 or step 51; if not, a subroutine 69 will cause a destination number to be set equal to the default destination for the case where the passenger will be leaving from the floor of the beacon which woke the device up. In other words, if the beacon is on the lobby, the default destination may be the passenger's office floor; if the passenger is on his office floor, the default destination may be the lobby. But if an alternative destination had been established and the alternative destination flag set in either step 36 or step 52, then step 69 is bypassed so as not to change the new destination which the passenger has entered purposefully. A step 72 will then cause the device 21 to transmit a message including its ID number, the beacon floor, and the destination, so that the beacon which woke up the device can receive the information and enter a call for the passenger 22 bearing the device 21. If the beacon is in a corridor, a hall call will be entered; if the beacon is in a car, a car call to the transmitted destination will be entered. A test 73 determines if the beacon which woke up the device is a car beacon. If it is, steps 75 and 76 will reset the token, and set the destination to all zeros, so that an affirmative action on the part of the potential passenger will be required the next time the passenger approaches an elevator beacon; otherwise, a call will not be entered for the passenger. That is, at some subsequent time when the device is awakened by a beacon, test 65 will be negative. This not only covers the situation where the passenger is approaching the elevators for a subsequent trip, or may only be passing such elevators, but it also covers the situation which occurs as the passenger leaves the elevator from this particular trip for which he has indicated an intent, so that a false call will not be entered for him at that time. An affirmative result of test 73 also causes a step 77 to reset the alternative destination flag, whether or not it had been previously set, so that upon the next approach to an elevator system, the alternative destination flag will not prevent the default destination from being established in step 69, unless a new destination is indeed entered by the passenger prior to that time. The token, the alternative destination flag and the destination may be reset at a later point in the passenger's trip, so long as it is done before the service is concluded (before the passenger reaches the destination of his trip).

In a space-access embodiment, the door would be unlocked or opened in response to transmission of the ID only; test 68, subroutine 69, test 73, and steps 76 and 77 are eliminated.

In another embodiment of the invention, the intent token and any alternative destination may be transferred to the building the first time that a passenger passes a beacon, and signal processing means within the building, such as a dispatching controller, keeps track of the token to register a hall call and then a car call for the passenger, and cancel the intent token and the alternative destination flag once the passenger enters the elevator car. In a space-access embodiment, the token may be received by any beacon and saved until the bearer responds to the beacon associated with the space. A device may have a plurality of space identifications transmitted to a building. In such case, the token for each identified space destination will be cancelled only by a beacon at the entrance to such space.

Figure 5:
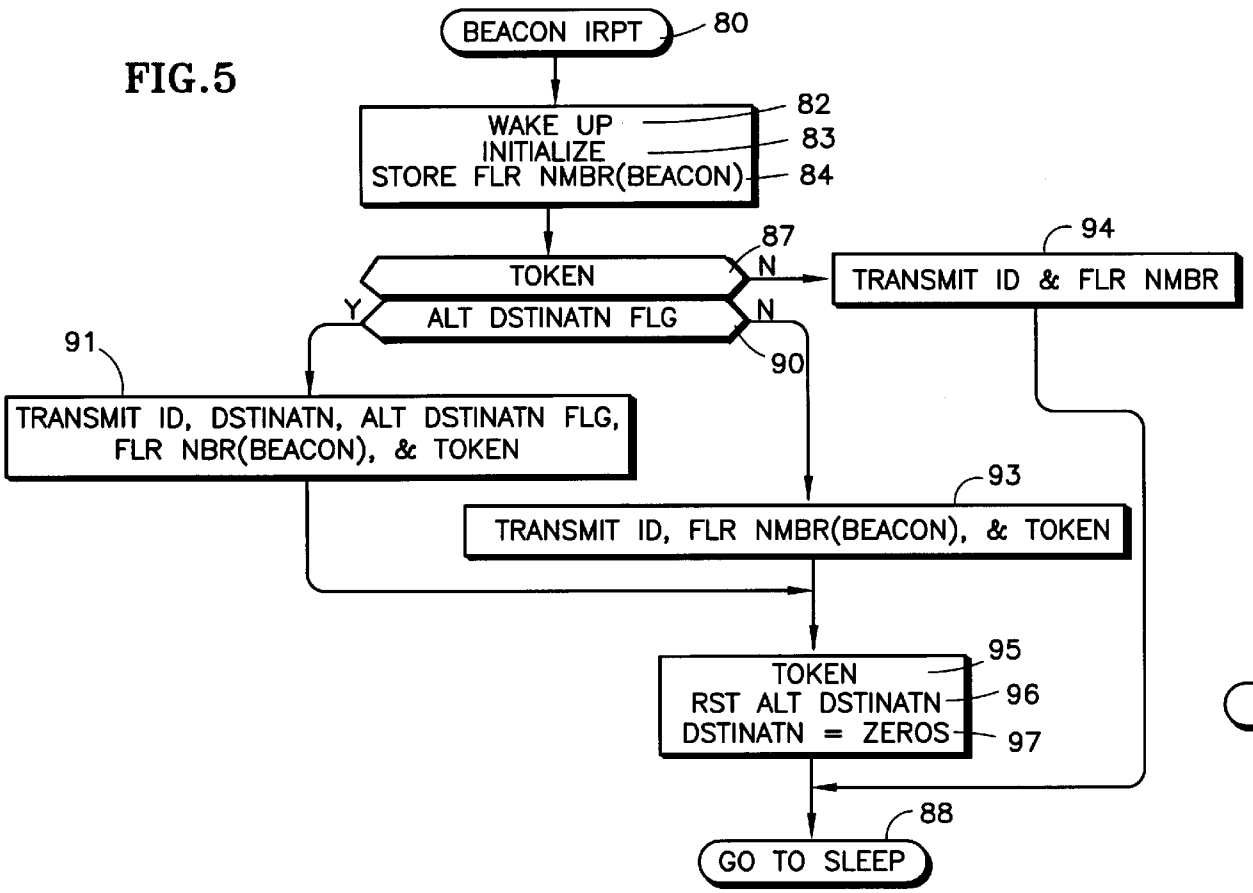
FIG. 5 is a simplified functional diagram of a beacon interrupt in an alternative embodiment of the invention.

Referring to FIG. 5, in an embodiment in which the building manages the tokens, a beacon interrupt in the portable device 21 may be reached through a point 80 and a first pair of steps 82, 83 cause the device to wake up and initialize and a step 84 stores the floor number of the beacon which caused the interrupt. A test 87 determines if the token was set, and if so, a test 90 determines if the alternative destination flag has been set or not. If so, a step 91 causes the device to transmit the ID, the destination, the alternative destination flag, the floor number of the beacon, and the token. In this embodiment, the floor number of the beacon is necessary, as in the preceding embodiment, only to ensure that the transmission will be ignored if picked up on a floor other than the floor of the beacon. If the alternative destination flag had not been set, a negative result of test 90 reaches a step 93 to cause the device to transmit the ID, the floor number of the beacon, and the token. If there is no token, it may be because the bearer did not cause it to be generated, or it may be because the token was previously transmitted and then erased. Therefore, to relate the bearer to the previously-stored token (if any) a negative result of test 87 reaches a step 94 to transmit just the ID and the floor number. In this embodiment, as soon as the device has transmitted the token and/or floor number and/or the alternative destination flag and destination, the token and alternative destination flag are reset by a pair of steps 95, 96 and the destination is set to zeros by a step 97, respectively. And then the device is caused to resume sleep through a point 98.

Figure 6:
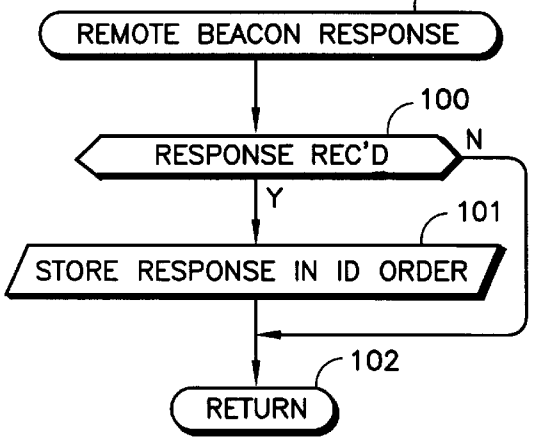
FIGS. 6–8 are simplified functional diagrams of various beacon response routines illustrating a second embodiment of the invention in which the token is managed by the building.
Figure 7:
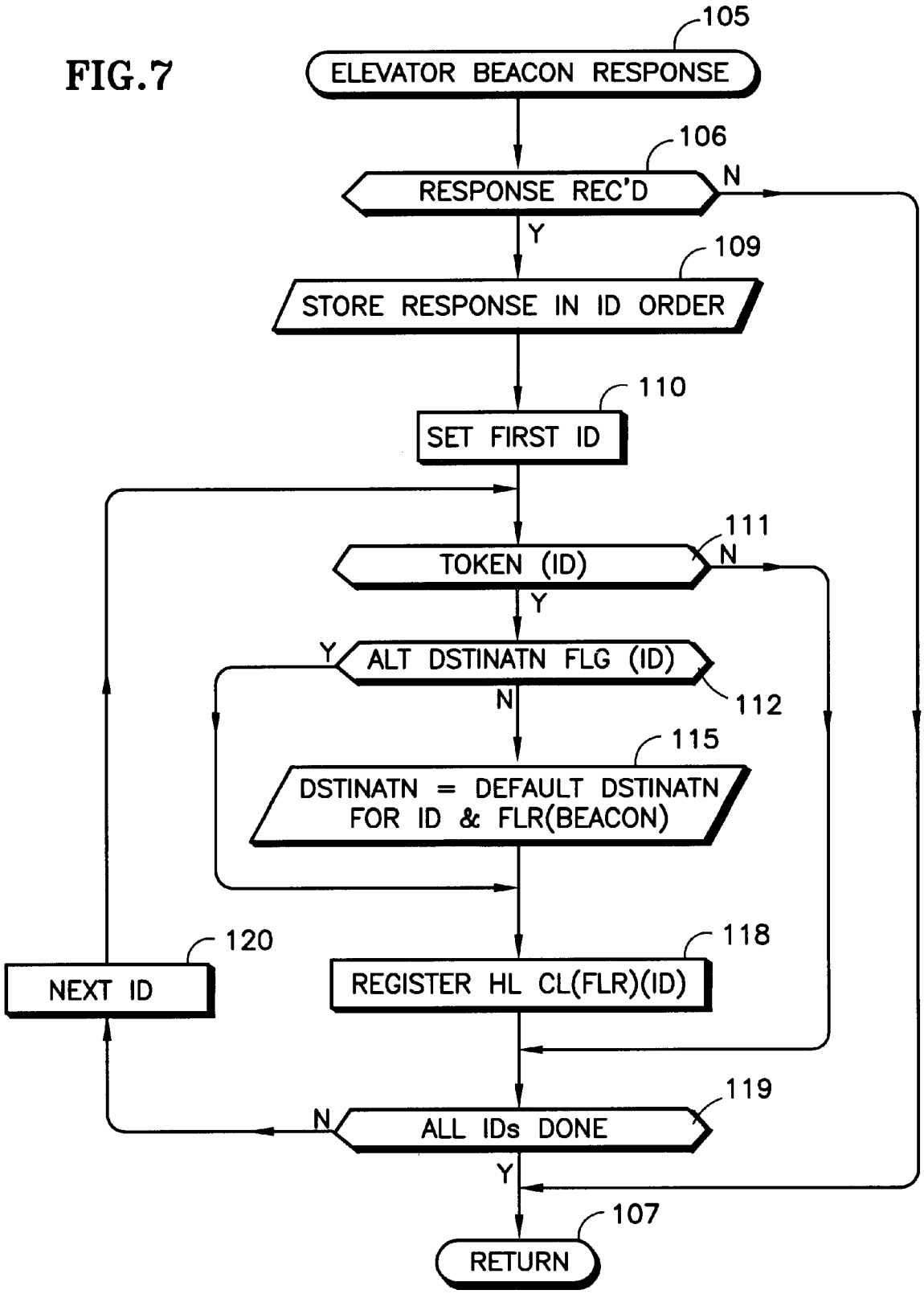
Figure 8:
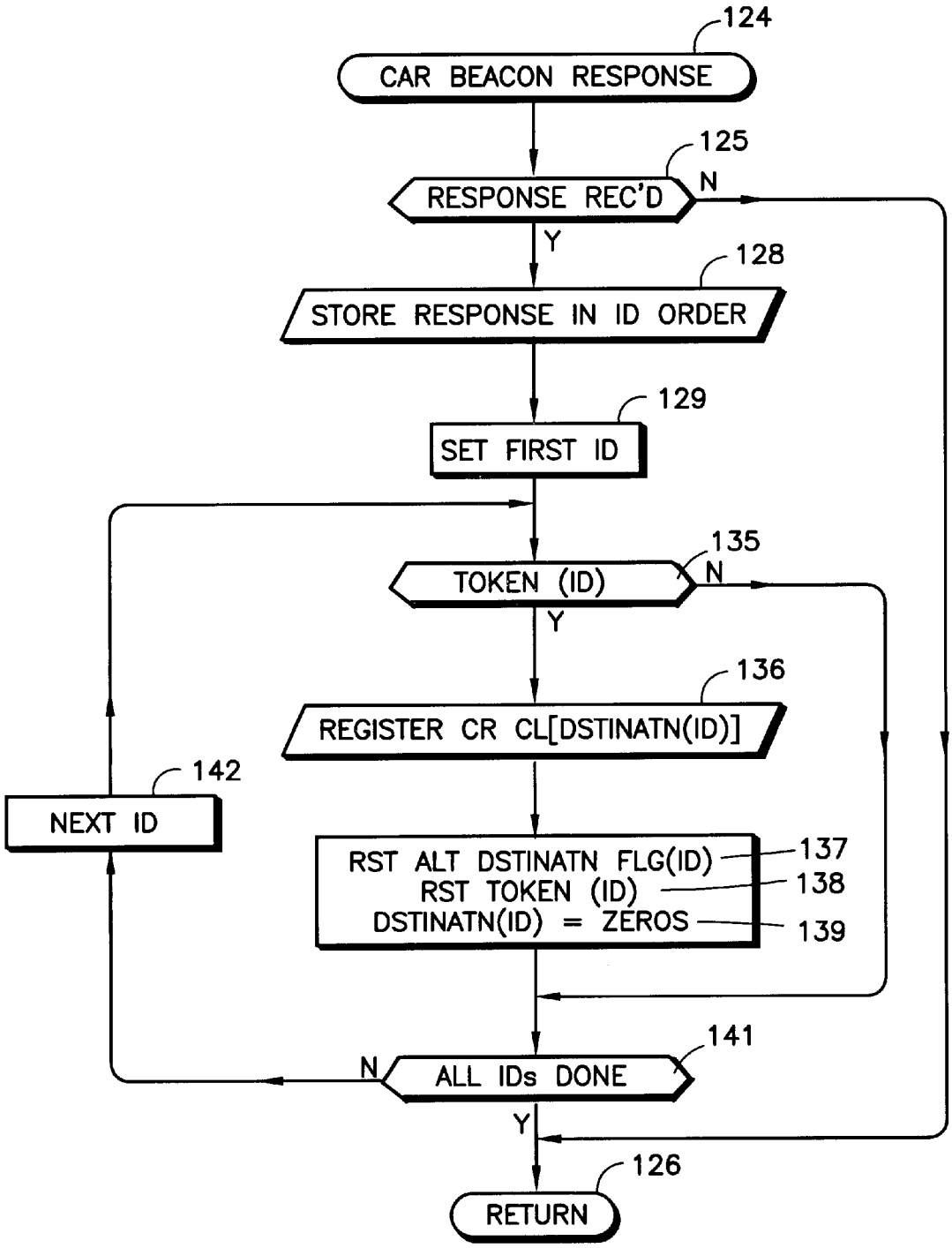

FIGS. 6–8 illustrate three functional routines which may be undertaken when a beacon receives a response from one or more portable devices. If a response is received by a remote beacon, such as the beacon 25 in FIG. 1, the routine of FIG. 6 may be entered through a point 99, and a test 100 determines if a response has been received; if so, a subroutine 101 causes any received responses to be stored in ID order, and other programming is reverted to through a return point 102. If no response has been received, the subroutine 101 is bypassed.

If a response is received by an elevator beacon, such as the beacon 24 in FIG. 1, the routine of FIG. 7 may be entered through a point 105 and a first test 106 determines if a response has been received; if not, other programming is reverted to through a return point 107. If any response has been received, a subroutine 109 causes all such responses to be stored in ID order. Then a step 110 points to the first stored response so that the content of that response can be identified. A test is used to scan through all possible ID to see which of them have transmitted a response. The test 111 determines if a token was received for that ID; if so, a test 112 determines if an alternative destination flag was transmitted with that ID. If not, a subroutine 115 will generate a destination which is a default destination for that particular ID when originating a trip from the particular floor upon which the elevator beacon is disposed. On the other hand, if there were an alternative destination flag transmitted with the ID, an affirmative result of test 112 bypasses the subroutine 115. Then a step 118 causes a hall call for the floor of the beacon to be registered for the related ID. A test 119 determines if the transmission received from all the ID's providing responses have been treated or not; if not, a step 120 causes the routine to reach the stored response of the next ID and the functions 111–118 are repeated. If no token has been received for each ID number in turn, the functions 112–118 are bypassed. When all of the received responses have been treated, an affirmative result of test 119 causes other programming to be reverted to through the return point 107.

To handle any response received from a car beacon, such as the beacon 20 in FIG. 1, the routine of FIG. 8 is reached through an entry point 124 and a first test 125 determines if any response has been received by the car beacon. If not, other programming is reverted to through a return point 126. But if so, all the responses are stored in ID order by a subroutine 128. Then all of the ID's are scanned to handle those that have responded. A test 135 determines if each ID has been received; if so, a subroutine 136 will cause a car call to be registered for the destination floor for that particular ID. The destination floor may either be one generated by the subroutine 115 in FIG. 7, or generated by the passenger having manipulated destination keys, as determined in subroutine 33 in FIG. 2 or 47 in FIG. 3. Once the car call is registered for that particular ID, a set of steps 137–139 will reset the alternative destination flag, the token for that ID, and set the destination for that ID to zeros. Then a test 141 determines if all of the IDs have been treated; if not, a step 142 causes the next ID to be identified, and the functions 135–141 are repeated for the next ID in turn. For any ID which has not responded, the functions 135–139 are bypassed. When all of the responding IDs have been treated, an affirmative result of test 141 causes other programming to be reached through the return point 126.

In the foregoing embodiments, the alterative destination flag is utilized to keep track, separately, that an alternative destination has been designated. However, it should be obvious that the flag is not required per se, since the alternative destination may be kept track of in the sense of being present when it is other than some specific number, such as all zeros or all ones, and absent when it is represented by some specific floor number. Specifically, tests 68, 90 and 112 could be "DSTINATN=ZEROS," with a negative result equaling the alternative destination flag.

Figure 4:
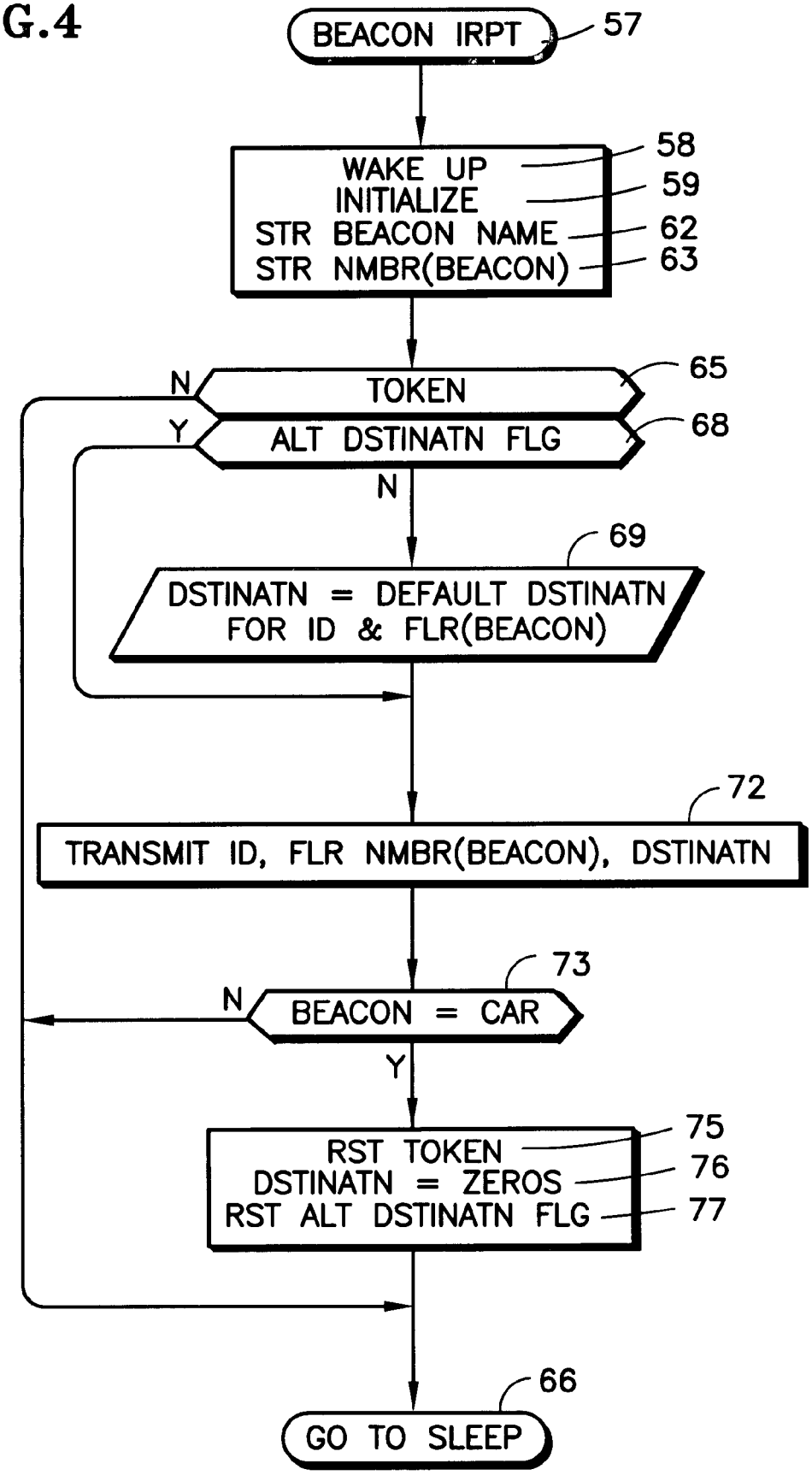
FIG. 4 is a simplified functional diagram of a beacon interrupt which may be utilized in a portable device of the present invention.
Figure 9:
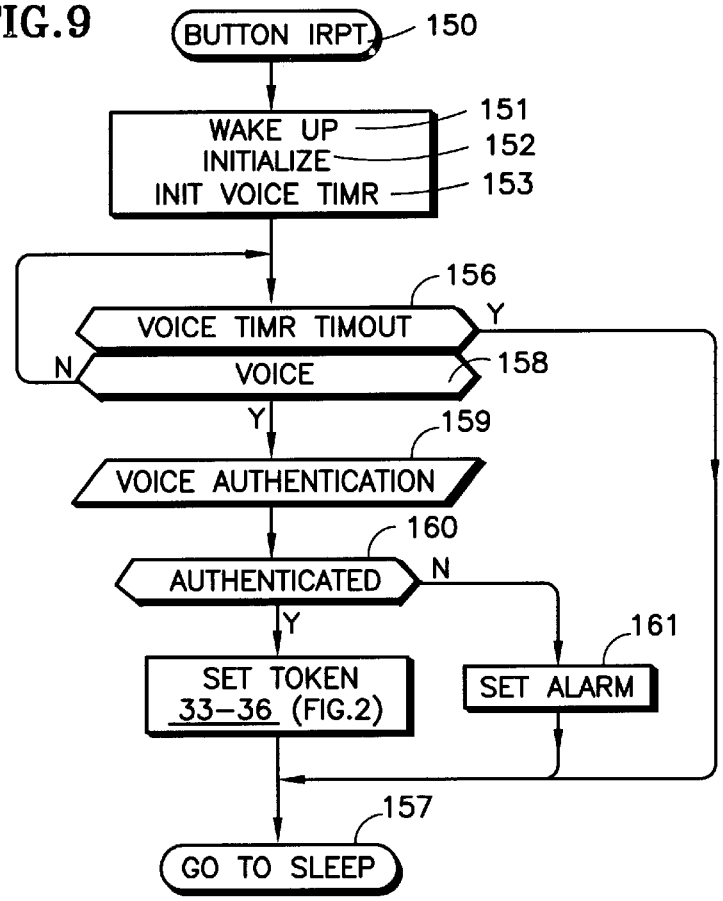
FIGS. 9–10 are variants of FIGS. 2 and 4 which include voice authentication for security.
Figure 10:
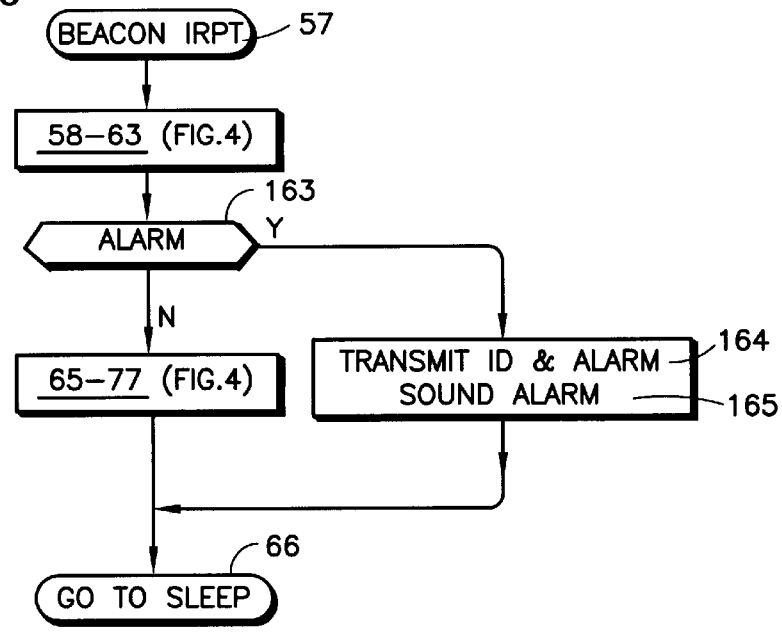

Any of the foregoing embodiments which employ a device having a voice input may be modified for use with secure elevators or secure spaces by means of voice authentication. The device may, instead of relying upon voice to wake up, which could cause it to wake up erroneously in response to ordinary conversation, may have a wake up button. Such a device may be as illustrated in FIG. 9, in which a wake up button interrupt 150 reaches a pair of steps 151, 152 to cause the device to wake up and initialize. Then a step 153 initiates a voice timer to establish a period of time within which, if the device does not recognize voice, it will go back to sleep. A test 156 determines if the voice timer has timed out; if it has, the device will go to sleep at a point 157. But if not, then a test 158 determines if the device recognizes voice or not. If not, the routine reverts to the test 156; this will continue either until time out or until voice is recognized, at which time a subroutine 159 will perform voice authentication. This is a conventional subroutine which will match either any words or some particular words spoken by the bearer to determine if the speaker is the authorized bearer assigned the device's ID. If it is not the authorized person's voice, a test 160 will be negative causing a step 161 to set an alarm. But if it is the authorized person's voice, then the steps 33–36 of FIG. 2 are performed, in either event the device then goes to sleep through the point 157. In such a modification, the use of the alarm may be within the functions of FIG. 4, as illustrated in FIG. 10. Therein, the beacon interrupt 57 will cause the steps 58–63 to be performed and then a test 163 will determine if the alarm was set in step 161 of FIG. 9, or not. If it was, a step 164 will transmit the ID of the device and an alarm. This will provide the building with information that a device is in the hands of an inappropriate user, and which device that is. Then a step 165 may sound an alarm, if desired, which may help security personnel apprehend the offender. But if the alarm was not set in FIG. 9, a negative result of test 163 causes step 65–77 to be performed as illustrated in FIG. 4. In either case, the device will then can go to sleep through the point 66. Any request for service by a restricted elevator or access to a restricted space can be screened by comparing the ID with lists of authorized persons.

Figure 11:
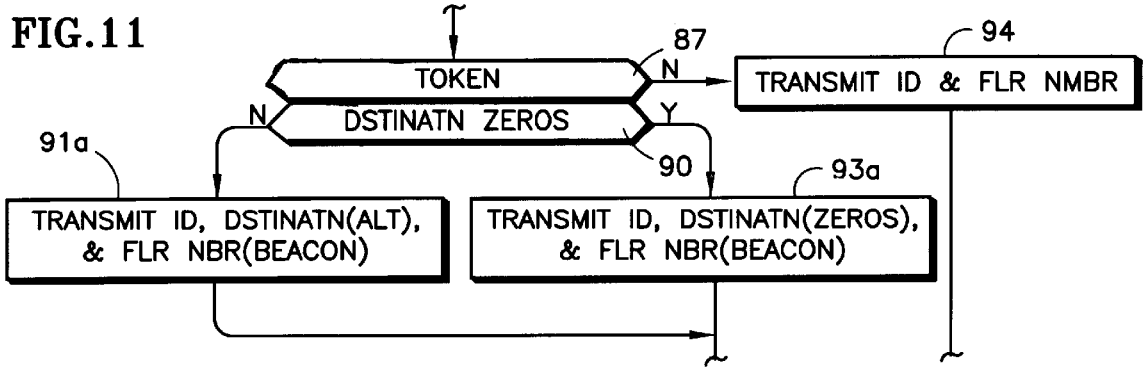
FIGS. 11–13 are variants of FIGS. 5, 7 and 2, respectively.

A modification that may be made to the embodiment of FIG. 5 is utilizing the destination field as an indication of whether an alternative destination has been provided, and as the token of intent to use the elevators. In FIG. 11, it is assumed that the destination field is always set to zeros unless an alternative destination is entered by the bearer. It is further assumed that the destination field of non-zeros is utilized as the alternative destination flag. Therefore, when the test 87 senses that a token indicating a request for elevator service is present, then a test 90 will cause a step 91*a* to transmit the ID, the alternative destination, and the floor number of the beacon; but if the destination is all zeros, then a step 93*a* will cause the device to transmit the ID, the destination of all zeros, and the floor number of the beacon. Within the system, a destination field of all zeros will be recognized as a cause for generating a default destination; where a destination field not of zeros will be taken as an indication that an alternative destination is not to be generated.

Figure 12:
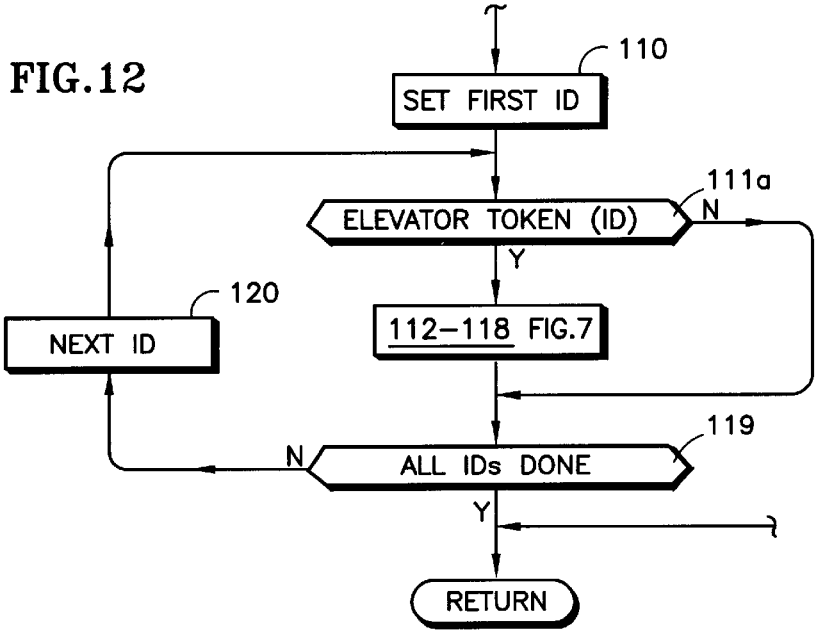
Figure 13:
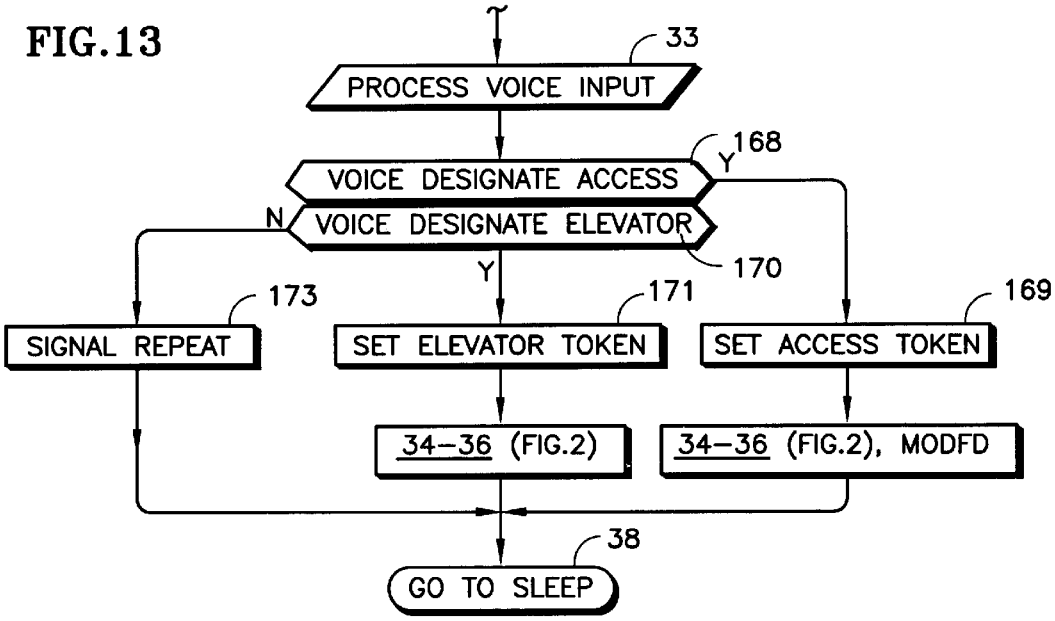

In a system having a separate elevator system and access system being utilized by devices which can generate tokens for either system, and in which the elevator system is separate from the access system, the routine may be as shown in FIG. 12. Therein, the only distinction from FIG. 7 is that the test 111*a* not only determines if the particular ID has a token, but that token must be an elevator token. A routine for a device that may generate elevator tokens and access tokens is illustrated in FIG. 13. Therein, following processing of the voice input by the subroutine 33, a test 168 determines whether the voice has designated a desire to have access or not. If so, a step 169 will set an access token and then the steps 34–36 of FIG. 2, modified to represent various spaces to which access may be had, are performed and then the device returns to sleep through the point 38. On the other hand, if the voice input did not designate a desire to gain access, then a test 170 determines if the voice designated a desire to utilize the elevator. If so, a step 171 will set an elevator token, and then the steps 34–36 of FIG. 2 will be performed, following which the device will return to sleep through the point 38. If the voice was unclear as to whether access or elevator service is desired, a negative result of test 170 may reach a step 173 to indicate to the bearer in some fashion that he should repeat his request, if desired. Of course, a single system in the building could manage both access and elevators, if desired.

The invention may be used where an elevator is not secure, but a destination floor and every space in the destination floor is secure; in such a case, egress from the elevator on a secure floor may only provide access to a small vestibule, use of the device being required to exit the vestibule to any other space on the floor.

The embodiment of FIG. 2 may be altered so as to require that the passenger verbalize his intent, with a word such as "elevator", or his floor number or the like, instead of setting the token automatically in response to any voice input. Similarly, the embodiments of FIG. 3 and FIG. 11 could be modified so that the token will automatically be set. Reference to a beacon "disposed within an elevator car" means a beacon disposed so that a portable device will not respond to it except as or when the passenger bearing it enters the elevator car.

The aforementioned patent and patent application are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A method of automatically (1) providing access to spaces controlled by an access system and (2) registering calls for service in an elevator system within a building, in response to transmissions from a portable device having bearer-operable data input means and carried by a unique potential occupant and/or passenger, comprising:

(a) providing in response to input to said device by said bearer, at least one of (1) an elevator token manifestation of said bearer's intent to use an elevator the next subsequent time that said bearer approaches the elevator, (2) a manifestation of a destination floor for an elevator call for service to be automatically registered for said bearer at a subsequent point in time, and at least one of (3) an access token manifestation of said bearer's intent to gain access to a space, and (4) a manifestation of a destination space to which said bearer desires access; and (b) transmitting at least one of (1) said token manifestations and (2) said destination manifestations from said device to said system;

(c) registering an elevator call for said bearer for elevator service only in response to the presence in said elevator system, if any, of one of (1) said elevator token manifestation and (2) said manifestation of a destination floor, and providing said bearer with access to a space only in response to the presence in said access system, if any, of one of (3) said access token manifestation and (4) said manifestation of a destination space; and (d) terminating said elevator token manifestation, if any, and said manifestation of a destination floor, if any, prior to said bearer concluding elevator service provided in response to said call, and terminating said access token manifestation, if any, and said manifestation of a destination space, if any, as soon as said access is provided in response thereto.

2. Apparatus for automatically (1) providing access to spaces controlled by an access system and (2) registering calls for elevator service to be provided by an elevator system in a building, comprising:

a portable device to be worn by a bearer, said portable device having data input means operable by said bearer to provide at least one of (1) an elevator token manifestation of said bearer's intent to use an elevator the next subsequent time that said bearer approaches said elevator, (2) a manifestation of a destination floor for elevator service desired by said bearer, and to provide at least one of (3) an access token manifestation of said bearer's intent to gain access to a space, and (4) a manifestation of a destination space to which access is desired by said bearer, said portable device transmitting at least one of said manifestations to said system;

means for registering an elevator call for said bearer for service only in response to the presence of at least one of (1) said elevator token manifestation and (2) said manifestation of a destination floor, and for providing said bearer with access to a space only in response to the presence of at least one of (3) said access token manifestation and (4) said manifestation of a destination space; and means for terminating said elevator token manifestation, if any, and/or said manifestation of a destination floor, if any, prior to said bearer concluding elevator service provided in response to said call, and for terminating said access token manifestation, if any, and/or said manifestation of a destination space, if any, as soon as said access is provided in response thereto.

3. A method of automatically providing access to spaces controlled by an access system in response to transmissions from a portable device having bearer-operable data input means and carried by a unique potential occupant, respectively, comprising:

(a) providing in response to input to said device by said bearer, at least one of (1) an access token manifestation of said bearer's intent to gain access to a space and (2) a manifestation of a destination space to which said bearer desires access;

(b) transmitting at least one of (1) said token manifestation and (2) said destination manifestation from said device to said system;

(c) providing said bearer with access to a space only in response to the presence in said access system, if any, of one of (1) said access token manifestation and (2) said manifestation of a destination space; and (d) terminating said access token manifestation, if any, and said manifestation of a destination space, if any, as soon as said access is provided to said bearer in response thereto.

4. A method of automatically registering calls for service in an elevator system within a building, in response to transmissions from a portable device having bearer-operable data input means and carried by a unique potential passenger, respectively, comprising:

(a) providing in response to input to said device by said bearer, at least one of (1) an elevator token manifestation of said bearer's intent to use an elevator the next subsequent time that said bearer approaches the elevator and (2) a manifestation of a destination floor for an elevator call for service to be automatically registered for said bearer at a subsequent point in time;

(b) transmitting at least one of (1) said elevator token manifestation and (2) said destination manifestation from said device to said system;

(c) registering an elevator call for said bearer for elevator service only in response to the presence in said elevator system, if any, of one of (1) said elevator token manifestation and (2) said manifestation of a destination floor; and (d) terminating said elevator token manifestation, if any, and said manifestation of a destination floor, if any, prior to said bearer concluding elevator service provided in response to said call.

5. A method according to claim 3 or 4 wherein said step (a) comprises providing said token manifestation but not said manifestation of a destination; and further comprising:

(e) providing a manifestation of a default destination.

6. A method according to claim 5 wherein said step (e) is performed by said device.

7. A method according to claim 5 wherein said step (e) is performed by said system.

8. A method according to claim 3 or 4 wherein at least one of (1) said token manifestation and (2) said manifestation of a destination are maintained in said device until completion of said step (c); and said step (d) is performed in said device.

9. A method according to claim 3 or 4 wherein said step (d) is performed in said device following said step (b), and said step (d) is performed in said system following completion of said step (c).

10. A method according to claim 3 or 4 wherein said steps (a) and (b) comprise providing and transmitting (1) both a token manifestation and a manifestation of a destination.

11. A method according to claim 3 or 4 wherein said step (a) comprises:

(f) providing an alternative destination manifestation in response to a specific input to said device indicative of said alternative destination; and (g) providing a default destination manifestation if said token manifestation is present unless said alternative destination manifestation is also present.

12. A method according to claim 11 wherein said step (g) is performed in said device.

13. A method according to claim 11 wherein said step (g) is performed in said elevator system.

14. A method according to claim 4 wherein said step (d) comprises:

terminating one or more of said (1) elevator token manifestation and (2) said manifestation of a destination floor in response to receipt by said device of a signal from a beacon disposed within an elevator car.

15. A method according to claim 3 wherein said step (a) consists solely of:

providing said access token manifestation; said step (b) consists solely of:

transmitting said access token manifestation; and said step (d) consists solely of:

terminating said access token manifestation.

16. A method according to claim 4 wherein said step (a) consists solely of:

providing said elevator token manifestation; said step (b) consists solely of:

transmitting said elevator token manifestation; and said step (d) consists solely of:

terminating said elevator token manifestation.

17. Apparatus for automatically providing access to spaces controlled by an access system in a building, comprising:

a portable device to be worn by a bearer, said portable device having data input means operable by said bearer to provide at least one of (1) an access token manifestation of said bearer's intent to gain access to a space and (2) a manifestation of a destination space to which access is desired by said bearer, said portable device transmitting at least one of said manifestations to said system;

means for providing said bearer with access to a space only in response to the presence of at least one of (a) said access token manifestation and (b) said manifestation of a destination space; and means for terminating said access token manifestation, if any, and/or said manifestation of a destination space, if any, as soon as said access is provided in response thereto.

18. Apparatus for automatically registering calls for elevator service to be provided by an elevator system in a building, comprising:

a portable device to be worn by a bearer, said portable device having data input means operable by said bearer to provide at least one of (1) an elevator token manifestation of said bearer's intent to use an elevator the next subsequent time that said bearer approaches said elevator and (2) a manifestation of a destination floor for elevator service desired by said bearer, said portable device transmitting at least one of said manifestations to said system;

means for registering an elevator call for said bearer for service only in response to the presence of at least one of (a) said elevator token manifestation and (b) said manifestation for a destination floor; and means for terminating said elevator token manifestation, if any, and/or said manifestation for a destination floor, if any, prior to said bearer concluding elevator service provided in response to said call.

19. Apparatus according to claim 17 or 18 wherein said apparatus further comprises:

default means for providing a manifestation of a default destination in the event that said passenger operates said data input means to provide a token manifestation but not to provide said manifestation of a destination.

20. Apparatus according to claim 19 wherein said default means is within said device.

21. Apparatus according to claim 19 wherein said default means is within said system.

22. Apparatus according to claim 17 or 18 wherein at least one of (1) said token manifestation, if any, and said manifestation of a destination, if any, are maintained in said device and said means for terminating is within said device.

23. Apparatus according to claim 17 or 18 wherein said means for terminating comprises:

first means for terminating said manifestations in said device after transmitting said manifestations and second means for terminating said manifestations in said system after use thereof in said system.

24. Apparatus according to claim 17 or 18 wherein at least one token manifestation is provided and transmitted.

25. Apparatus according to claim 18 wherein said means for terminating terminates any of said manifestations in response to a signal from a beacon within an elevator car.

26. Apparatus according to claim 17 or 18 wherein said portable device comprises means for authenticating the voice of the bearer before providing any of said manifestations.

* * * * *